US008920298B2

(12) United States Patent
Gerhard et al.

(10) Patent No.: US 8,920,298 B2
(45) Date of Patent: Dec. 30, 2014

(54) METHOD OF, AND APPARATUS FOR, PROCESSING A MOVING, PRINTED MATERIAL WEB

(75) Inventors: Jakob Gerhard, Brittnau (CH); Martin Gfeller, Oftringen (CH)

(73) Assignee: Hunkeler AG, Wikon (CH)

( * ) Notice: Subject to any disclaimer, the term of this patent is extended or adjusted under 35 U.S.C. 154(b) by 949 days.

(21) Appl. No.: 12/453,661

(22) Filed: May 18, 2009

(65) Prior Publication Data

US 2009/0289406 A1 Nov. 26, 2009

(30) Foreign Application Priority Data

May 20, 2008 (EP) ..... 08 009 232

(51) Int. Cl.
*B31B 1/14* (2006.01)

(52) U.S. Cl.
USPC ..... 493/356; 493/401; 493/422

(58) Field of Classification Search
USPC ..... 493/356, 401, 422, 416, 63, 254, 419; 270/60, 52.25, 50, 42
See application file for complete search history.

(56) References Cited

U.S. PATENT DOCUMENTS 3,665,817 A * 5/1972 Katz et al. ..... 493/216
4,190,242 A * 2/1980 Bolza-Schunemann ..... 270/50
4,279,409 A * 7/1981 Pemberton ..... 270/5.02
4,538,517 A 9/1985 Michalik et al.
4,635,915 A * 1/1987 Sato ..... 270/49
4,901,993 A * 2/1990 Hansch ..... 270/21.1
4,931,035 A * 6/1990 Schmidt ..... 493/216
5,197,262 A * 3/1993 Katz et al. ..... 53/550
5,230,501 A 7/1993 Melton
5,938,243 A 8/1999 De Santo
6,073,421 A * 6/2000 Lee ..... 53/206
6,865,864 B2 * 3/2005 Katz ..... 53/460
6,945,923 B2 * 9/2005 Graber et al. ..... 493/401

FOREIGN PATENT DOCUMENTS

EP 0 107 126 A 5/1984

* cited by examiner

*Primary Examiner* — Sameh H. Tawfik
(74) *Attorney, Agent, or Firm* — Oliff PLC

(57) ABSTRACT

A method and apparatus of moving printed material web includes two processing arrangements arranged one above the other that are optional in operation. A material web is processed either in the upper, first processing arrangement or in the lower, second processing arrangement. In the processing section belonging to the first processing arrangement, the material web is folded about a line parallel to its advancement direction. In the processing section belonging to the second processing arrangement, the material web is separated, along a line parallel to its advancement direction, into two material-web strands, which are then positioned one above the other. The two processing sections having in common a pair of braking rollers and a pair of drawing rollers and also a longitudinal-cutter.

11 Claims, 4 Drawing Sheets

METHOD OF, AND APPARATUS FOR, PROCESSING A MOVING, PRINTED MATERIAL WEB

BACKGROUND

The present invention relates to methods of, and apparatus for, processing a printed material web moving in an advancement direction. The material web is preferably printed by a digital printer.

It is known for endless material webs printed in a digital printer to be processed into end products in a processing line following the digital printer. It is desirable for end products of various types to be produced using the same processing line.

SUMMARY

One object of the present invention, is to provide method and apparatus which make it possible for printed material webs to undergo different kinds of processing in a time-saving and space-saving manner.

Two processing sections are used on an optional basis and allow a printed material web to undergo different kinds of processing, and make it possible for products of different types to be produced in one and the same processing line. Arranging the processing sections one above the other shortens the processing line, which gives rise to a space-saving construction. Using a folding mechanism of roof-like design for the longitudinal folding of the material web also contributes to such a space-saving construction. Changeover from one processing mode to the other processing mode, i.e. changeover from processing of the material web in the one processing section to processing in the other processing section, can be done easily in that, when the one processing section is not in use, it is moved, preferably by lateral displacement, into a non-operational position outside the movement path of the material web.

DETAILED DESCRIPTION OF EMBODIMENTS

Figure 1:
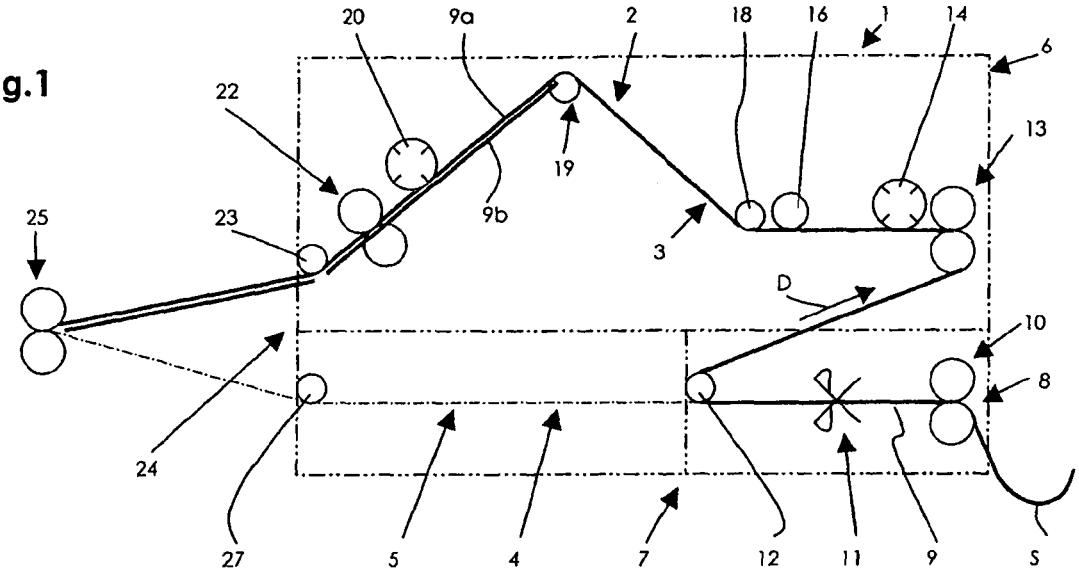
FIGS. 1 and 2 are a side view and a plan view, respectively, of the apparatus according to an embodiment of the invention during longitudinal folding of the material web.

The construction of the processing apparatus 1 according to the invention will be described in the first instance with reference to FIGS. 1, 2 and 4, 5.

This processing apparatus 1 has a first processing arrangement 2 with a first processing section 3 and a second processing arrangement 4 with a second processing section 5. The processing arrangement 2 belongs to a first processing unit 6, while the second processing arrangement 4 belongs to a second processing unit 7. The two processing units 6 and 7 are arranged one above the other and have a common entry 8 for the material web 9 which is to be processed.

Figure 5:
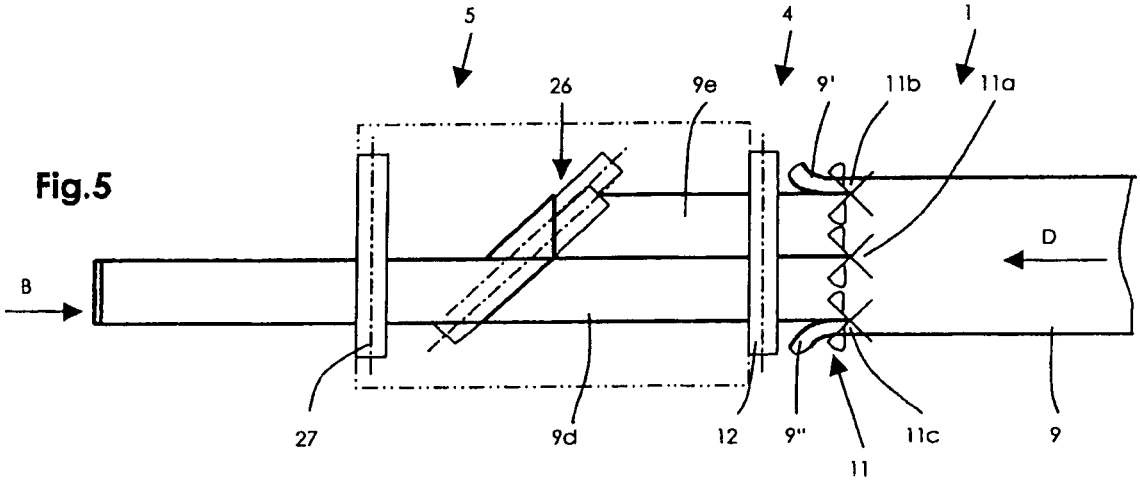

The material web 9, which runs into the processing apparatus 1 through the entry 8, runs through a pair of braking rollers 10, which has a merely schematically indicated longitudinal-cutting means 11 arranged downstream of it, as seen in the running direction D of the material web 9. As FIG. 5 shows, this longitudinal-cutting means 11 has a web-cutting unit 11*a* which serves for the longitudinal cutting of the material web 9 along a line parallel to the advancement direction D. The longitudinal-cutting means 11 also includes border-cutting units 11*b* and 11*c* which serve, if required, to cut away the border portions 9' and 9" of the material web 9. A deflecting roller 12 is arranged downstream of the longitudinal-cutting means 11. The pair of braking rollers 10, the longitudinal-cutting means 11 and the deflecting roller 12 are accommodated in the lower processing unit 7 and belong both to the first processing section 3 and the second processing section 5.

Figure 2:
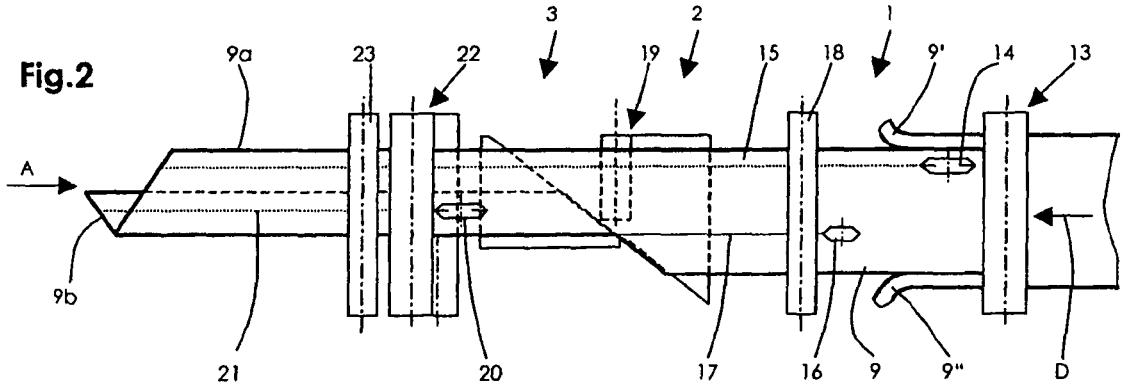

The first processing section 3 also has a pair of transporting rollers 13 and a perforating unit 14, which are both accommodated in the upper processing unit 6. The perforating unit 14 serves to produce longitudinal perforations 15 (tear-off perforations). It is also possible, however, for the perforating unit 14 to be set such that the line of perforations 15 is located along the envisaged folding line. The perforating unit 14 has arranged downstream of it a scoring unit 16 which provides the material web 9 with scoring 17 running along the envisaged folding line. It is also possible, however, to dispense with the scoring unit 16. In this case, folding takes place without scoring 17. As FIG. 2 shows, this scoring 17 (and thus the folding line) may be offset laterally in relation to the center line of the material web 9. Provided downstream of the scoring unit 16, as seen in the advancement direction D of the material web 9, is a web-guiding roller 18, which is followed by a roof-like folding mechanism 19, which is indicated in FIG. 1. This folding mechanism 19 serves for folding the material web 9 along a folding line in a manner known per se. The folded material web runs past a second perforating unit 20, which produces longitudinal perforations 21 (tear-off perforations) which pass through the two material-web strands 9*a*, 9*b* located one above the other. It is also possible, however, for this second perforating unit 20 to be dispensed with. Arranged downstream of the perforating unit 20 is a pair of transporting rollers 22, which is followed by a compensating roller 23 which is arranged in the region of the exit 24 from the processing apparatus 1. A pair of drawing rollers 25 is also provided in this exit region 24. In the case of the exemplary embodiment shown in the figures, this pair of drawing rollers 25 is part of a downstream cross-cutting means, which is not shown in any more detail. It is also possible, however, for this pair of drawing rollers 25 to be configured as part of the processing apparatus 1.

The above described structural elements 13, 14, 16, 18, 20, 22 and 23 belonging to the first processing section 3 are accommodated in the upper processing unit 6.

Figure 4:
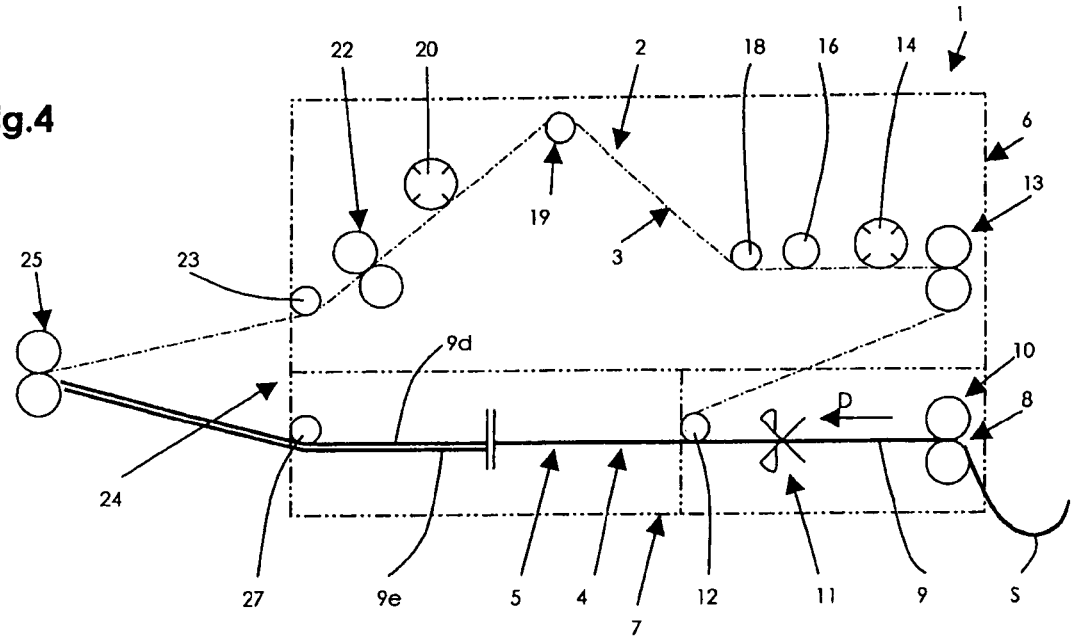

As can be gathered, in particular, from FIGS. 4 and 5, the lower, second processing arrangement 4, in addition to the pair of braking rollers 10, the longitudinal-cutting means 11 and the deflecting roller 12, which in the second processing arrangement 4 serves only as a web-guiding roller, also includes angle bars 26, via which the one material-web strand 9*e* is guided, and the web-guiding roller 27, which is arranged in the region of the exit 24.

Figure 7:
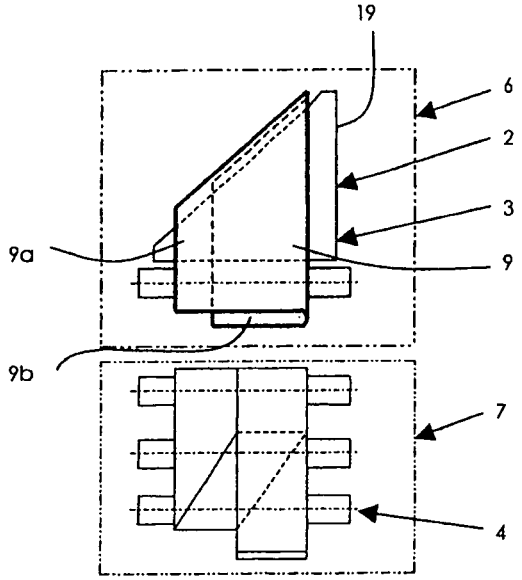
FIG. 7 shows a front view of the two processing arrangements arranged one above the other, with the upper processing arrangement in its operating position.

The two processing arrangements 2 and 4 arranged one above the other are used alternately—as is yet to be described. If the material web 9 is to be processed in the upper processing section 2, that is to say folded, then the upper processing unit 6 is located in its operating position, which is shown in FIG. 7 and in which it is located above the lower processing unit 7 and thus in the movement path of the material web 9.

Figure 8:
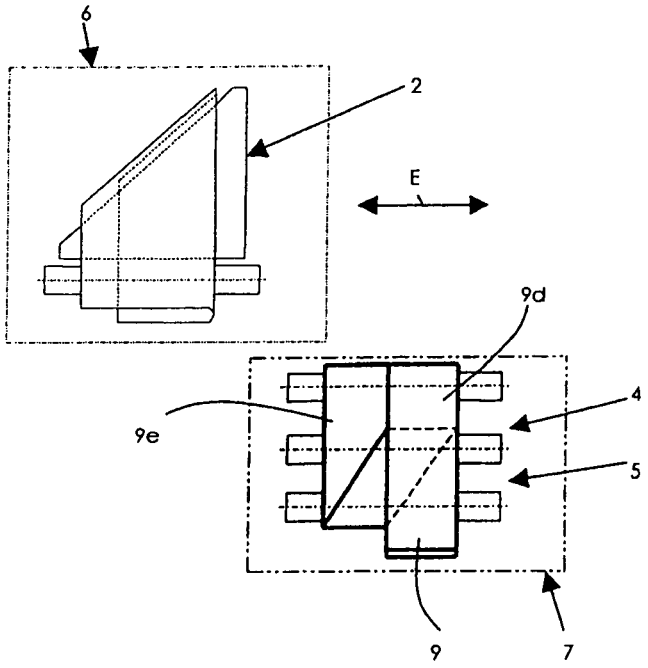
FIG. 8 shows a front view of the two processing arrangements arranged one above the other, with the upper processing arrangement in a non-operational position.

If, in contrast, the material web 9 is to be processed in the lower, second processing section 5, then the upper processing unit 6 is moved into its non-operational position, which is illustrated in FIG. 8. This is done by the upper processing unit 6 being displaced laterally in a direction E, which runs at right angles to the advancement direction D of the material web 9 as is illustrated in FIG. 8. In this non-operational position, the upper processing unit 6 is thus located to the side of the movement path of the material web 9.

A description will now be given hereinbelow of how the material web 9 is processed either in the upper, first processing section 3 or in the lower, second processing section 5.

Figure 3:
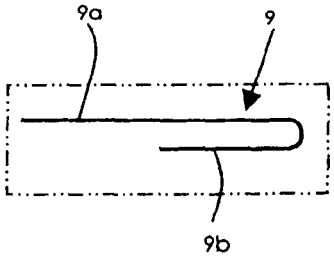
FIG. 3 is a schematic of the folded material web as seen in the direction of the arrow A in FIG. 2, FIGS. 4 and 5 show a side view and a plan view, respectively, of the apparatus according to an embodiment of the invention during longitudinal cutting of the material web and positioning of the material-web strands one above the other.

FIGS. 1-3, then, will be used to explain the processing of the material web 9 in the upper processing section 3.

As FIG. 1 shows, the material web 9 is fed in a loop S to the entry 8 of the processing apparatus 1. The tensile stressing in the material web 9 running through the processing apparatus 1 is produced by the pair of braking rollers 10 and the pair of drawing rollers 25. As the material web 9 runs past the longitudinal-cutting means 11, the border portions 9' and 9" (FIG. 2) are severed. The web-cutting unit 11*a* is not activated here. The material web 9 is then guided upwards, via the deflecting roller 12, into the upper processing unit 6. The material web 9 then runs through the pair of transporting rollers 13 and is subsequently provided with longitudinal perforations 15 by means of the perforating unit 14. The scoring unit 16 which follows provides the material web 9, along the envisaged folding line, with longitudinal scoring 17 which, in the case of the exemplary embodiment shown is offset laterally in relation to the center line of the material web 9. Downstream of the web-guiding roller 18, the material web 9 runs over the roof-like folding mechanism 19, which results in the material web 9 being folded along the scoring 17. The material web 9 is guided via the folding mechanism 19 under tensile stressing. This tensile stressing is produced by the pair of transporting rollers 13, arranged upstream of the folding mechanism 19, and the pair of transporting rollers 22, arranged downstream of the folding mechanism 19. By means of the perforating unit 20, the two material-web strands 9*a*, 9*b* of the folded material web 9, the strands being located one above the other, are provided with longitudinal perforations 21. The folded material web 9 passing out of the first, upper processing units 6 is guided via the compensating roller 23 and passes to the pair of drawing rollers 25, which, as has already been mentioned, belongs to the following processing unit.

FIG. 3 shows, the narrower material-web strand 9*b* is located beneath the wider material-web strand 9*a*. The fold here is located on the left-hand side, as seen in the advancement direction D of the material web 9. By virtue of the folding mechanism 19 being changed over, it is also possible for the material web 9 to be folded such that the fold is located on the right-hand side, as seen in the advancement direction D of the material web 9. By virtue of the scoring unit 16 and of the folding mechanism 19 being adjusted in a direction running at right angles to the advancement direction D of the material web 9, it is possible to change the position of the scoring 17 and of the folding line. The width of the material-web strands 9*a* and 9*b* can be adjusted in this way.

If the material web 9 is then to be processed, rather than in the first processing section 3 as described, in the lower, second processing section 5 (FIGS. 4-6), then the upper processing unit 6 is displaced into the non-operational position as is shown in FIGS. 7 and 8 and has already been described with reference to these figures. If the material web 9 is still located in the first, upper processing section 3, then it is necessary during this changeover, prior to the displacement of the upper processing unit 6, for the material web 9 to be severed in the region of the deflecting roller 12 and introduced into the second processing section 5.

Figure 6:
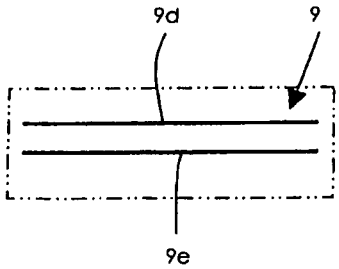
FIG. 6 shows two material-web strands located one above the other, as seen in the direction of the arrow B in FIG. 5.

In the case of the material web 9 being processed in the lower, second processing section 5, as shown in FIGS. 4-6, the material web 9 is likewise fed in a loop S to the entry 8 of the processing apparatus 1. Transportation of the material web through the processing section 5 under tensile stressing is also effected here by the pair of braking rollers 10 and the pair of drawing rollers 25. During passage through the longitudinal-cutting means 11, the border-cutting units 11*b*, 11*c* cut away the border portions 9', 9" and the web-cutting unit 11*a* separates the material web 9, along a line parallel to the advancement direction D, into two material-web strands 9*d* and 9*e* (FIG. 5). The one material-web strand 9*d* runs through the second processing section 5 along an essentially rectilinear movement path, whereas the material-web strand 9*e* located alongside it is guided via angle bars 26 such that the right-hand material-web strand 9*e*, as seen in the advancement direction D, ends up located beneath the left-hand material-web strand 9*e*, as seen in the advancement direction D, as seen in FIG. 6. It is also possible, however, for the material-web strand 9*e* to be guided via the angle bars 26 such that this material-web strand 9*e* ends up located above the other material-web strand 9*d*. This operation of the two material-web strands 9*d*, 9*e*, which are originally located one beside the other, being positioned one above the other is known per se. The material-web strands 9*d*, 9*e* located one above the other run past the web-guiding roller 27 and reach the pair of drawing rollers 25.

It is also possible to separate the material web 9 in the longitudinal-cutting means 11 into more than two material-web strands and then to position these material-web strands one above the other.

Figure 9:
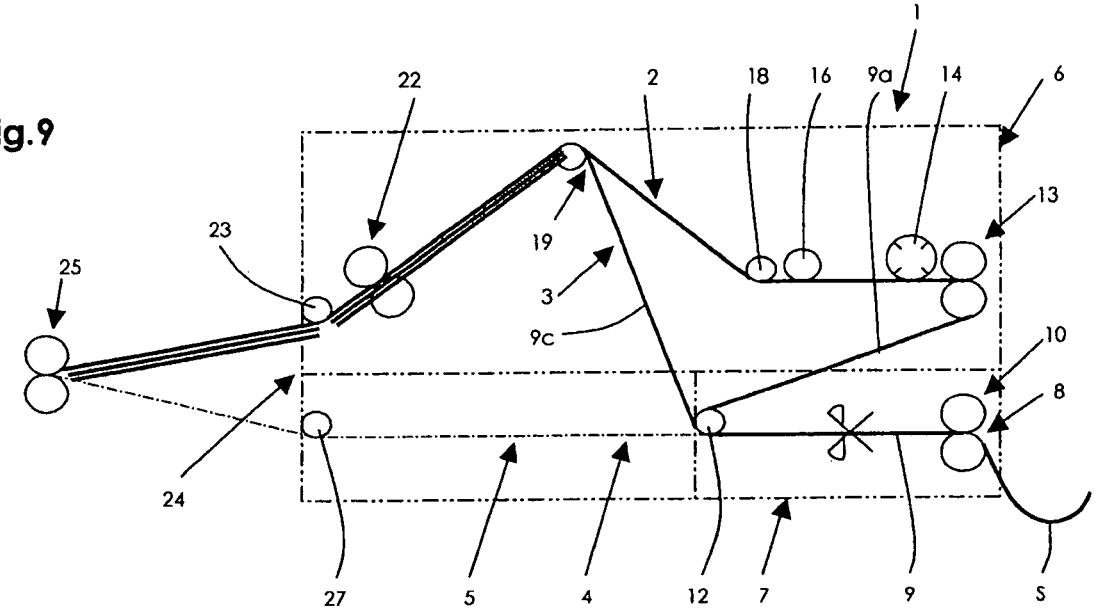
FIGS. 9 and 10 show a side view and a plan view, respectively, of the apparatus according to an embodiment of the invention for the longitudinal folding of the material web.
Figure 10:
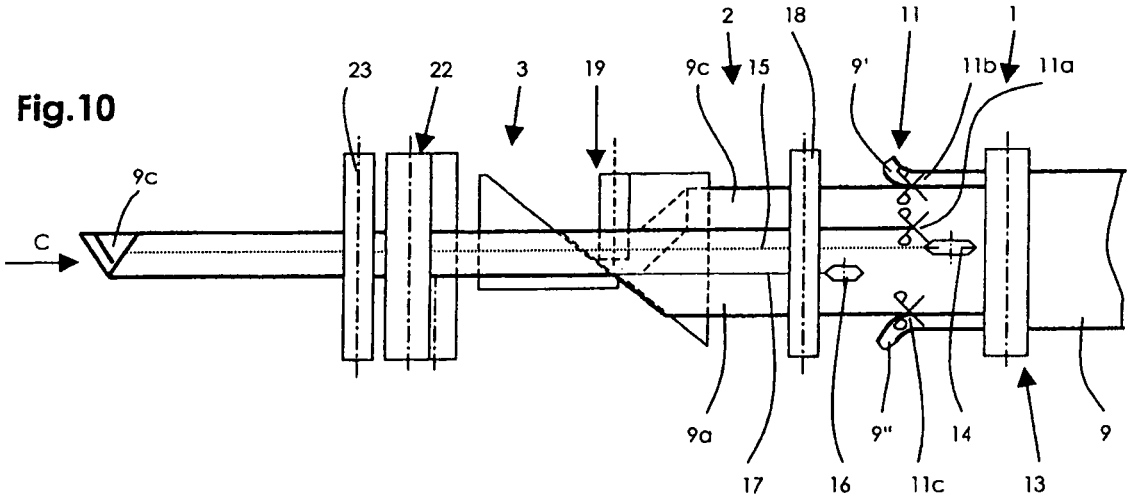
Figure 11:
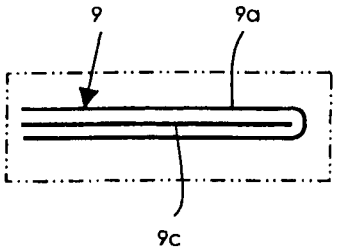
FIG. 11 shows the folded product as seen in the direction of the arrow C in FIG. 10.

FIGS. 9-12 show another possible way of processing the material web 9 in the upper, first processing section 3. In the case of this embodiment, the material web 9, in the longitudinal-cutting means 11 is not only trimmed along the border, but separated into two material-web strands 9*a* and 9*c* by means of the web-cutting unit 11*a*. The material-web strand 9*a* runs through the processing section 3 in the same way as has been described with reference to FIGS. 1 and 2. That is to say, the material-web strand 9*a* is provided with longitudinal perforations 15 and with scoring 17. In contrast, the material-web strand 9*c* is guided from the deflecting roller 12 directly to the folding mechanism 19 and, upstream of this folding mechanism 19, is brought together with the other material-web strand 9*a* from beneath. As FIG. 11 shows, by virtue of the material-web strand 9*a* being folded, the material-web strand 9*c* is incorporated in the folded material-web strand 9*a*. As can be gathered from FIGS. 10 and 11, the material-web strand 9*a* in the non-folded state is approximately double the width of the other material-web strand 9*c*.

Figure 12:
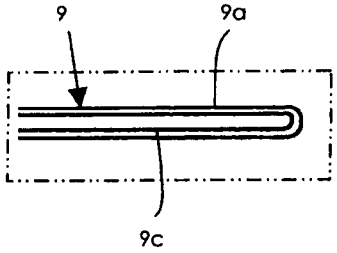
FIG. 12 shows a variant of the folded product in the direction of the arrow C in FIG. 10.

If, however, the material web 9 is divided up into two material-web strands 9*a*, 9*c* of approximately equal width and the material-web strand 9*c* is fed to the folding mechanism 19 in alignment with the material-web strand 9*a*, this gives rise to the end product which is illustrated in FIG. 12, and in which both material-web strands 9*a* and 9*c* are folded.

In the case of the embodiment which is shown in FIGS. 9 and 10, the perforating unit 20 has been done away with. It goes without saying, however, that it is also possible, if required, for such a perforating unit 20 to be provided for this embodiment.

It is, of course, also possible for the material web 9 to undergo processing steps other than those described in the first processing section 3 or second processing section 5.

In the case of a further variant, a further folding unit may be provided in the processing apparatus 1 downstream of the folding mechanism 19 or downstream of the angle bars 26 as seen in the advancement direction D, in order for the material web 9 which has already been folded to be folded again and/or for the two material-web strands 9*d*, 9*e* located one above the other to be folded.

It has been described with reference to FIGS. 7 and 8 that the upper processing unit 6 is moved out of the movement path of the material web 9 by lateral displacement. It is also possible, however, for this first processing unit 6 to be moved into the non-operational position by displacement in the upward direction.

In the case of the exemplary embodiments shown, the processed material web 9 leaving the processing apparatus 1 is fed to a cross-cutting apparatus. Of course, it is also possible, instead of such a cross-cutting apparatus, to provide processing modules of other types.

What is claimed is:

1. A method of processing a printed material web moving in an advancement direction in a processing apparatus, the method comprising:

deciding whether to guide the printed material web through one of a first processing section and a second processing section of the processing apparatus;

guiding the printed material web based on the decision through either the first processing section, where the printed material web is longitudinally folded about a folding line parallel to the advancement direction or the second processing section, where the printed material web is separated, by longitudinal cutting along at least one line parallel to the advancement direction, the printed material web being cut into at least two material-web strands, which are then positioned one above the other, wherein the first processing section and second processing section are arranged as an upper processing section and a lower processing section, one of the first processing section and the second processing section above the other.

2. The method of claim 1, wherein the upper processing section, when not in use, is moved out of the movement path of the printed material web.

3. The method of claim 1, wherein, during processing of the printed material web in the upper processing section, the printed material web is deflected upward via at least one deflecting roller on an incoming side of the upper processing section.

4. The method of claim 1, wherein lateral border regions of an incoming material web of the printed material web are cut away prior to either (1) folding in the first processing section or (2) the longitudinal cutting of the printed material web in the second processing section.

5. The method of claim 1, wherein the printed material web is braked at entry to the first processing section and the second processing section and the printed material web is driven at an exit of the first processing section and the second processing section.

6. The method of claim 1, wherein, in the first processing section, the printed material web is guided, with tensile stressing, via a folding mechanism of roof-like design.

7. The method of claim 6, wherein the tensile stressing is produced by transporting rollers arranged upstream and downstream of the folding mechanism.

8. The method of claim 1, wherein, prior to the longitudinal folding in the first processing section, the printed material web is at least one of scored and perforated along the folding line.

9. The method of claim 1, wherein, at least one of prior to and following the longitudinal folding in the first processing section, the printed material web is provided with longitudinal perforations.

10. The method of claim 1, wherein, prior to the longitudinal folding of the printed material web in the first processing section, a material-web strand is severed from the printed material web along a line parallel to the advancement direction, and the severed material-web strand is positioned on a remaining material-web strand prior to the longitudinal folding of the material web strand.

11. The method of claim 1, wherein, in the second processing section, for positioning the material-web strands above one another, the material-web strand is guided via angle bars.

* * * * *